United States Patent [19]

Thomas et al.

[11] Patent Number: 4,929,367

[45] Date of Patent: May 29, 1990

[54] ANTISTATIC AND FABRIC SOFTENING LAUNDRY WASH CYCLE ADDITIVE COMPOSITION IN FILTERING POUCH

[75] Inventors: James M. Thomas, Woodbridge; Ronald D. Kern, Buttzville, both of N.J.

[73] Assignee: Colgate-Palmolive Co., Piscataway, N.J.

[21] Appl. No.: 916,069

[22] Filed: Oct. 6, 1986

[51] Int. Cl.[5] ..... D06M 13/34; D06M 13/46

[52] U.S. Cl. ..... 252/8.8; 252/91; 252/118; 252/122; 252/174; 252/528; 252/547

[58] Field of Search ..... 252/90, 110, 118, 174, 252/8.8, 547, 528; 427/242, 393.1; 8/137

[56] References Cited

U.S. PATENT DOCUMENTS

| | | | |
|---|---|---|---|
| 1,922,085 | 4/1933 | Goudey | 68/11 |
| 3,869,399 | 3/1975 | Collins | 252/118 |
| 4,348,293 | 9/1982 | Clarke et al. | 252/90 |
| 4,356,099 | 10/1982 | Davies et al. | 252/174 |
| 4,659,496 | 4/1987 | Klem et al. | 252/90 |

FOREIGN PATENT DOCUMENTS 0818419 7/1969 Canada .

*Primary Examiner*—A. Lionel Clingman
*Assistant Examiner*—John F. McNally
*Attorney, Agent, or Firm*—Bernard Lieberman; Murray M. Grill

[57] ABSTRACT

An antistatic and fabric softening laundry wash cycle additive article includes an antistatic and fabric softening composition in a filtering container, from which a complex of cationic surfactant and anionic surfactant is released into the wash water through the filtering walls of the container. The particles of the released complex, the size of which are controlled by the sizes of the filtering openings in the container walls, are small enough so that they do not form objectionable greasy deposits on the laundry, such as often results when antistatic and fabric softening cationic surfactant is present with anionic surfactant in a detergent composition, or is added to the wash water with such detergent composition. The cationic surfactant may be present in the filtering container as a complex with anionic surfactant or in mixture with anionic surfactant, in particulate form. It is preferred that it be present as such a mixture and also present may be suitable functional and aesthetic materials, such as: bentonite, builders and fillers, which add bulk to the product and separate the reactive anionic and cationic materials during storage; emulsifiers, which facilitate the production of cationic/anionic complex in finely divided emulsified form after the article is added to the wash water, thereby facilitating passage of such complex in such finely divided, emulsified form through the filtering container, and preventing greasy deposition of such complex on the laundry being washed; and perfume.

Also within the invention are processes for simultaneously washing laundry and treating it to soften it and make it antistatic, in which processes the filtering container of this invention, preferably as a heat sealed pouch of nonwoven polyester or other suitable synthetic organic polymer in fibrous form, and containing the cationic/anionic surfactants mixture, is added to the wash water. Preferably, the invented article is also present in the rinse water and is transferred to an automatic laundry dryer with the laundry being dried. The greater advantages of the invented process are obtained when the laundry detergent employed is an anionic detergent but the invented articles may also be used in the wash cycle when nonionic or other types of detergents are employed.

19 Claims, 1 Drawing Sheet

ANTISTATIC AND FABRIC SOFTENING LAUNDRY WASH CYCLE ADDITIVE COMPOSITION IN FILTERING POUCH

This invention relates to an antistatic and fabric softening article intended for addition to wash water, as in the wash cycle of an automatic washing machine. More particularly, the invention is of such a wash cycle additive article which includes cationic and anionic surfactants, in complex or unreacted particulate form, inside a filtering pouch made of non-woven fibrous materials, such as polyester fibers.

Various cationic surfactant (surface active) compounds have long been known and have long been employed as fabric softeners and antistatic agents in treating laundry. Because it was known that such compounds reacted adversely with anionic materials, including detergents, in wash waters, for many years such cationic surfactants were incorporated only in preparations intended for addition to the rinse water (in which the anionic detergent was not present). That necessitated a special trip to the laundry room by the person doing the laundry, to add the antistat-softener to the rinse water. Because much laundry washing today is done by automatic washing machines, and such machines are not normally equipped with audible signals indicating the beginning of the rinse cycle, often the washing and rinsing would be completed and the addition of the cationic surfactant to the rinse water would have been unintentionally omitted. Thus, it was considered highly desirable to be able to have a means or preparation for adding cationic surfactant, such as quaternary ammonium salt or imidazolinium salt, in the wash cycle, together with the detergent composition. However, such addition resulted in the reaction, by ionic bonding, of the cationic surfactant with various materials in the wash water, such as with anionic detergent to produce a waxy water insoluble (at wash water temperature) reaction product, with anionic fluorescent brighteners, and with color anions from the tap water, which reaction products could then deposit on the laundry. Due to such ionic bonding reactions detergency would be decreased, as would be fluorescent brightening of the laundry, and greasy deposits of the reaction product on the laundry could appear colored (usually yellowed).

Despite the disadvantages of the use of cationic fabric softening and antistatic surfactants in the wash cycle in conjunction with anionic detergents, anionic detergent compositions have been made which contained such cationic surfactants. Such products require the employment of additional anionic detergent and fluorescent brightener (to make up for amounts of such compounds which reacted with the cationic surfactant) and deposits of greasy reaction product on the laundry would still occur. However, in the present invention, wherein such anionic/cationic surfactant complexes are intentionally made and packed in a filtering pouch or container, or the anionic and cationic surfactants which form such complexes are packaged in such filtering pouch, when the invented article is added to the wash water the complex present or formed is filtered by the pouch wall and is deposited on the laundry in very small units rather than in larger deposits, which are objectionable because they are visible to the naked eye and look like grease spots. Yet, the finely divided complex effectively adheres to the laundry in esssentially invisible deposits, which soften the laundry and effectively diminish or prevent "static cling" of laundered items, such as is often observed when laundry that is washed is made up in whole or in part of synthetic polymeric materials, and is subjected to tumble drying after washing and rinsing.

In accordance with the present invention an antistatic and fabric softening laundry wash cycle additive article comprises an antistatic and fabric softening composition in a filtering container, which composition comprises a complex of a cationic surfactant and an anionic surfactant, in which complex the proportion of anionic surfactant is at least equimolar with respect to that of the cationic surfactant, or a mixture of cationic surfactant and anionic surfactant, in which mixture the proportion of the anionic surfactant is at least equimolar with respect to that of the cationic surfactant, which complex or mixture is in a filtering container which, when the container and its contents are added to wash water in an automatic washing machine, filters materials passing through it so that cationic/anionic surfactant complex passing through walls of the container is of small enough sizes so that it does not form objectionable greasy deposits on laundry being washed. Also within the invention are processes for using the invented articles as fabric softeners and antistats in the wash cycle of an automatic washing machine in an operation in which the detergent employed is a built synthetic anionic organic detergent, and additionally employing the invented articles in the rinse cycle and in the drying of the laundry in an automatic laundry dryer.

Searches of the available prior art and of other records have resulted in the findings of U.S. Pat. No. 4,000,077 (hereby incorporated by reference) and U.S. Pat. No. 4,062,647. The '077 patent discloses a textile softening composition which contains, as essential components, a cationic quaternary softener, such as an imidazolinium salt, and a minor amount of a higher aliphatic alcohol sulfate. This patent discloses various imidazolinium salts and higher aliphatic alcohol sulfates, together with procedures for reacting them. The patent teaches that the described softening compositions could be made in liquid or particulate form, adsorbed onto a carrier, but employment thereof was only in the rinse water. The '647 patent discloses bentonite as a fabric softening and antistatic component of detergent compositions. In addition to the mentioned patents, it is recognized that single use containers of detergent compositions and fabric softeners were in the prior art. Also, it was known to pack detergent compositions in water soluble films, such as polyvinyl alcohol. However, so far as applicants know, the prior art does not disclose or make obvious applicants' employment of a filtering container, such as a non-woven, synthetic organic polymeric fibrous pouch, e.g., of heat sealed polyester fibers, which allows water to pass through it when the article is added to the wash water during the washing cycle, which water promotes reaction of the anionic and cationic surfactants to form the fabric softening and antistatic complex (if such was not already present), and which filters such complex so that only small sized particles thereof pass through it and into the wash water, thereby preventing the deposition of the complex on the laundry as greasy smears. The presence of builders and fabric softening agents, such as bentonite, in particulate form in the filtering container, helps to control the nature of the complex formed in the pouch, tending to keep it smaller in particle sizes, so as to facilitate passage of it through the very fine openings in the pouch material, and similar effects are obtained when an emulsifier is present with the mixture of cationic and anionic surfactants in the article.

Applications of the inventors' co-worker, Dean G. Klewsaat and of Ronald D. Kern above, entitled respectively, Cationic/Anionic Surfactant Complex Antistatic and Fabric Softening Emulsion for Wash Cycle Laundry Applications, and Fabric Softening and Antistatic Particulate Wash Cycle Laundry Additive Containing Cationic/Anionic Complex on Bentonite, and filed on the same day as the present application, are considered to be of interest, and therefore are mentioned herein. The former, Ser. No. 06/916,067, relates to a fabric softening and antistatic complex of anionic and cationic surfactants in an emulsion intended for addition to the wash water, and the latter, Ser. No. 06/916,068 is for a similar fabric softening antistatic agent deposited on bentonite powder (which also functions as a fabric softening agent) so that the composition is in particulate agglomerate form.

The cationic surfactant employed may be any suitable cationic surfactant which has either fabric softening or antistatic properties. Primarily, those cationic materials which are most useful are what will be referred to as quaternary ammonium salts, which are those wherein at least one higher molecular weight group and two or three lower molecular weight groups are linked to a common nitrogen atom to produce a cation and wherein the electrically balancing anion is a halide, acetate or lower alkosulfate ion, such as chloride or methosulfate. The higher molecular weight substituent on the nitrogen is preferably higher alkyl group, containing 12 to 18 or 20 carbon atoms, such as cococ-alkyl, tallowalkyl, hydrogenated tallowalkyl or substituted higher alkyl, and the lower molecular weight substituents are preferably lower alkyl of 1 to 4 carbon atoms, such as methyl or ethyl, or substituted lower alkyl. One or more of said lower molecular weight substituents may include an aryl moiety or may be replaced by an aryl, such as benzyl, phenyl or other suitable substituent. A preferred quaternary ammonium salt is a di-higher alkyl, di-lower alkyl ammonium halide, such as di-tallowalkyl dimethyl ammonium chloride or di-hydrogenated tallowalkyl dimethyl ammonium chloride, and other quaternary ammonium chlorides will also usually be preferred.

In addition to the cationic compounds previously mentioned, other suitable cationic surfactants include the imidazolinium salts, such as 2-heptadecyl-1-methyl-1-[(2- stearoylamido) ethyl]-imidazolinium chloride; the corresponding methyl sulfate compound; 2-methyl-1-(2-hydroxyethyl)-1-benzyl imidazolinium chloride; 2-coco-1-(2-hydroxyethyl)-1-benzyl imidazolinium chloride; 2-coco-1-(2-hydroxyethyl)-1-octadecenyl imidazolinium chloride; 2-heptadecenyl-1-(2-hydroxyethyl)-1-(4-chlorobutyl) imidazolinium chloride; and 2-heptadecyl-1-(hydroxyethyl)-1-octadecyl imidazolinium ethyl sulfate. Generally, the imidazolinium salts of preference will be halides (preferably chlorides) and lower alkylsulfates (alkosulfates).

Others of the mentioned quaternary ammonium salts and imidazolinium salts having fabric softening and/or antistatic properties may also be employed in the present invention and various others of such compounds are described in U.S. Pat. No. 4,000,077.

The anionic surfactants which may be reacted with the cationic surfactants to form complexes employed in the manufacture of the articles of this invention may be any suitable anionic surface active agents, including those utilized for their detersive, wetting or emulsifying powers, but usually these will preferably be anionic detergents. Such detergents will normally include a lipophilic anionic moiety of relatively high molecular weight, which lipophile will preferably be or include a long chain alkyl or alkenyl group of at least 12 carbon atoms, such as of 12 to 18 carbon atoms. Such lipophilic moiety will usually include a sulfonic, sulfuric or carboxylic group so that when neutralized there will be produced a sulfonate, sulfate or carboxylate, with the cation preferably being an alkali metal, ammonium or alkanolamine, such as triethanolamine. The higher alkyls of such surfactants may be from 10 to 20 carbon atoms but normally will be of 12 to 18 carbon atoms, and in the present invention will preferably be of 12 to 16 carbon atoms. Examples of the anionic surfactants include sodium dodecylbenzene sulfonate, sodium linear tridecylbenzene sulfonate, potassium octadecylbenzene sulfonate, sodium lauryl sulfate, triethanolamine lauryl sulfate, sodium palmityl sulfate, sodium cocoalkyl sulfate, sodium tallowalkyl sulfate, sodium ethoxylated higher fatty alcohol sulfate of 1 to 30 ethylene oxide groups per mole, such as sodium monoethoxy octadecanol sulfate and sodium decaethoxy cocoalkyl sulfate, sodium paraffin sulfonate, sodium olefin sulfonate (of 10 to 20 carbon atoms in the olefin), sodium cocomonoglyceride sulfate, and sodium cocotallow soap (1:4 coco:tallow ratio). Preferred anionic detergents for complexing with the cationic surfactants are the higher alkylbenzene sulfonates, the higher fatty alcohol sulfates, and the ethoxylated higher fatty alcohol sulfates, in which the salt forming cation is preferably alkali metal, more preferably sodium. Although individual cationic and anionic surfactants are referred to above it is to be understood that mixtures of each of said types cf compounds are intended to be included, too.

The cationic and anionic surfactants in the filtering container are desirably (but not necessarily) separated by particulate material, which can be soluble or insoluble builder, detergent composition base beads or final product, bentonite or filler. Adjuvants may also be present. Use of such particulate material gives the product more bulk, facilitating measuring, and helps to prevent formation of large accumulations of waxy or greasy complex. An emulsifier may also be present to facilitate passage of the complex through the pouch wall. Such particulate materials and/or emulsifier may also be in the pouch when the complex is charged to the pouch, and will have similar effects.

The builders that are used include organic and inorganic materials and may be water soluble or water insoluble. Preferably, the builders are inorganic and are selected from the group consisting of polyphosphates, carbonates, bicarbonates, borates, silicates, zeolites, and mixtures thereof, but sodium tripolyphosphate, sodium pyrophosphate, sodium carbonate, sodium bicarbonate, sodium silicate, sodium borate, and mixtures, which are soluble, are more preferred. Among the fillers that may be employed are alkali metal sulfates and chlorides, especially the sodium salts thereof, and of these, sodium sulfate is much preferred. The bentonite that may be employed is a swelling bentonite, preferably of the Wyoming type. Such is described in the Kern application, previously mentioned, and incorporated herein by reference. The bentonite may be in separate powder or agglomerate forms and may be agglomerated with the cationic/anionic surfactant complex, as described in the Kern application. The emulsifiers that may be employed are any such that are suitable, and preferably they are in powder form. Suitable emulsifiers include the higher alkyl ethoxylated alcohols and amines and higher fatty acid complexes of the amines, such as the Neodols ®(-Shell Chemical Co.) and the Ethomeens ® and TAM-8, TAM-20 and TAM-40 (Emery Industries). The emulsifiers are described in greater detail in the Klewsaat application previously mentioned, which is incorporated by reference.

The filtering container utilized is any suitable container that may be charged to an automatic washing machine in the wash cycle (and preferably may be present in such machine during the rinse cycle and may be then transferred to an automatic laundry dryer drum with laundry to be dried) and which will release from its interior to the wash water in the washing machine small particles or droplets of cationic/anionic complex, so that such complex will fasten to the laundry being washed but will not form greasy deposits or spots on the laundry that are apparent to a viewer. It is considered that the filtering action of the container should be such that it prevents passage therethrough of particles larger than 250 microns in diameter. Preferably it will prevent passage of particles larger than 50 microns and more preferably will prevent passage of those particles larger than 20 microns. When the openings in the container wall or "outlet" portion are less than 5 microns they could tend to become plugged with complex or other materials present in the container interior and one normally will not employ such very fine filtering containers.

A preferred form of container is made of non-woven fabric, which acts like a filter. The fabric may be heat sealed, fused, cemented, sewn or otherwise fastened about its border, and may be of any desirable shape, normally being either square, rectangular or circular in shape and, when packed with contents, resembling a pillow. A single layer of non-woven fabric may be employed or plural layers may be used to assist in regulating the filtering action. A preferred non-woven fabric will have a thickness in the range of 30 to 120 microns with a pore size in the range of about 8.5 to 31 microns. A suitable non-woven polyester material is marketed by the Kendall Corporation which identifies it by No. 149–026. Such material is 100% polyester and has a pore size of 19.8 microns ±11.3. The open area (for transmission of small particulates through the material) is about 1.4%. Similar non-woven fabrics may be made of rayon, rayon-polyester blends, other suitable polymers, and in some cases, of cellulosics, including paper, but it is desirable that any such material employed should not disintegrate under washing conditions.

The invention will be readily understood from this specification and the following description of the drawing of an invented article, in which drawing.

Figure 1:
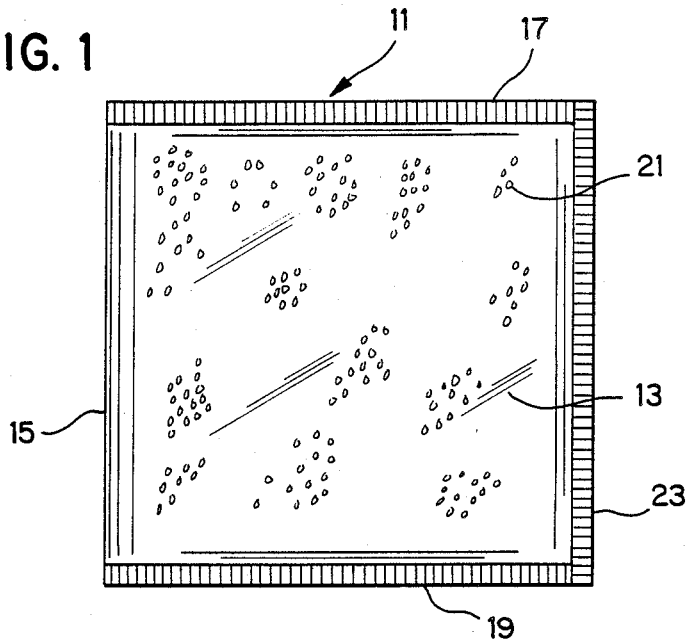
FIG. 1 is a top plan view of an article of the invention.
Figure 2:
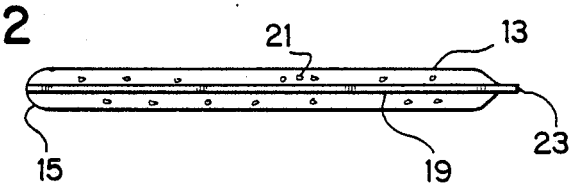
FIG. 2 is an elevational view thereof.

In FIG. 1 fabric softening and antistatic article or packet 11, as illustrated, is made from a sheet of nonwoven polyester film 13 which is folded over at side 15 and is heat sealed at edges 17 and 19, after which contents 21 are inserted into the packet, and edge 23 is also heat sealed. That closes the packet and prevents the contents from leaking out of the packet, except through the small passageways in the walls of the non-woven material, not specifically illustrated, through which the cationic-/anionic complex may pass during washing action.

As illustrated, the article is substantially flat but when more of the fabric softening and antistatic complex, extenders, builders, adjuvants, etc., is also present, the profile of the packet may change to a pillow shape.

The proportion of cationic surfactant to anionic surfactant in the invented article will be such that there will be an equimolar proportion (the stoichiometric proportion) thereof or there will be an excess of anionic surfactant. Any excess of anionic surfactant can be useful in adding extra detergent capability to the wash water. Normally, however, such excess will not be more than 10:1 or 20:1 and preferably, the ratio will be about equimolar, such as in the range of 1:1 to 1:1.5 cationic/anionic, more preferably being exactly equimolar or stoichiometric. When a particulate material, such as a builder, a filler, base beads, spray dried detergent composition beads or bentonite is in the packet or other filtering container, there will normally be present from 5 to 30 parts of such particulate material per ten parts of cationic/anionic complex or mixture of cationic or anionic surfactants. Preferably, such ratio will be about 10 to 25 parts of particulate material per ten parts of complex or mixed surfactants. The particulate material present in the packet with the active component(s) will preferably be water soluble so that when dissolved it may pass readily through the pores or openings in the container, and will help to purge them, rather than block them, as an insoluble builder or filler might do. When an emulsifier is present in the packet the proportion thereof will normally be from 0.5 to 20 parts by weight of emulsifier or a mixture of emulsifiers per ten parts by weight of complex or cationic/anionic surfactant mixture. A preferred range is about 2 to 15 parts by weight of emulsifier and a more preferred range is about 8 to 12 parts by weight of emulsifier per ten parts by weight of complex or mixture.

The packet or filtering container will normally hold enough of the complex or related mixture to treat the charge of laundry (normally about 3 to 4 kilograms) in an automatic washing machine, which is normally of 60 to 70 liter capacity (wash water volume). Thus, the preferred weight of complex or components thereof will normally be in the range of 2 to 20 grams per packet and the weight of the entire packet, including complex or components thereof, and any builders, fabric softeners, fillers, emulsifiers and adjuvants, will be in the range of 5 to 100 grams. Preferred ranges are 5 to 15 grams and 10 to 50 grams, respectively.

The manufacture of the present particles has been described in reference to the drawing. Also, the complexes, if to be made, may be made following the procedure described in the Klewsaat and Kern patent applications, and herein, and the making of the reactant mixtures, possibly with other materials, too, is by conventional mixing procedures.

The invented articles are normally employed in wash water containing a built synthetic organic anionic detergent composition, (but they can be used with nonionic detergent compositions, too), and are useful to soften laundry and render it free of "static cling". In such a process the built synthetic organic anionic detergent composition, either in particulate, liquid or other suitable form, is first added to the wash water, preferably in an automatic washing machine, followed by the laundry, after which the invented article is added to the wash water. The built detergent will be of an anionic surfactant detergent like those previously discribed and any builder(s) and filler(s) will be like those mentioned earlier. The proportions of detergent:builder:filler in the detergent composition will be 5 to 35%, 10 to 80%, and 0 to 50%, preferably 15 to 30%, 25 to 70%, and 0 to 40%, respectively. The wash water temperature will normally be in the range of 30° to 95° C., preferably 30° . to 60° . or 35° C. to 50° C., e.g., about 40° C. or 50° . The concentration of built detergent composition will normally be in the range of 0.05 to 0.5%, preferably being 0.1 to 0.3% and more preferably being 0.1 to 0.2%. The weight of complex or cationic/anionic mixture employed in the article will usually be in the range of 2 to 20 grams, preferably 5 to 15 grams, and the article will usually weigh 5 to 100 grams, preferably 10 or 20 to 50 grams, with the given ranges of such weights being for a 3 to 4 kg. laundry load in 60 to 70 liters of water.

The following examples illustrate but do not limit the invention. Unless otherwise indicated, all parts in the examples, specification and claims are by weight and all temperatures are in ° C.

EXAMPLE 1

Stoichiometric proportions of distearyl dimethyl ammonium chloride and sodium linear tridecylbenzene sulfonate are weighed out and are mixed together until uniformly blended, after which twelve grams of the mixture are blended with twenty grams of sodium sulfate powder and are added to 10 cm×10 cm pouches of Kendail Corporation non-woven polyester fabric No. 149-026, weighing 75.3 g./sq. m. The non-woven fabric has an effective pore size of about 19.8 microns, ±11.3 microns, with the open area being 1.4%±0.8%. Thus, this non-woven fabric is an effective filter for particles and globules more than 20 microns in diameter. The pouch is heat sealed to close it and the resulting article is a useful wash cycle additive for addition to the wash water of automatic washing machines, which usually contain about 65 liters of water in the wash tub. 100 Grams of a commercial laundry detergent, containing about 4% of sodium linear dodecylbenzene sulfonate, about 12% of sodium higher (12 to 15 carbon atoms) fatty alcohol ethoxylate (one to three ethoxy groups per mole), 35% of sodium tripolyphosphate, 5% of sodium silicate, 25% of sodium sulfate, 5% of water, and the balance of various functional adjuvants, are added to 65 liters of wash water at a temperature of about 49° C., to which various test fabrics have been added, to test detergency against stains on different fabrics, to test static cling (on synthetic polymers) and to test fabric softening action (on cotton). The automatic washing machine is activated and the test fabrics are washed in a normal washing cycle, followed by rinsing and drying in an automatic laundry dryer. The pouch is carried through the rinsing cycle and is added to the laundry dryer.

After completion of the washing and drying the test fabrics are evaluated against control fabrics which are washed in the built anionic detergent composition alone and in the anionic detergent composition to which the pouch quantity of cationic surfactant has been added, and it is found that the test fabrics are appreciably softer, less prone to accumulate static charges (free of static cling) and cleaner than the control in which the quaternary ammonium halide was separately added to the wash water. The experimental fabrics are much better than the control washed only with synthetic anionic organic detergent composition with respect to fabric softening and antistatic action, and cleaning power is essentially the same. In addition, no greasy spotting is obtained with the experimental treatment whereas the control treatment results in noticeable grease spotting of the laundry. Similar results are obtained when the pouch is removed after rinsing and is not added to the dryer, but fabric softening and antistatic effects are noticeably less.

EXAMPLE 2

The experiments described in Example 1 are repeated but with a pre-reacted complex made by reacting the cationic and anionic surfactants in equimolar (stoichiometric proportions). This experimental run is compared to a run in which the complex is directly added to the washing machine, without being enclosed in a pouch like that described. Use of the experimental product results in good softening and antistatic effect, with no grease spotting being observable. However, when the complex is added directly to the washing machine grease spotting on the test fabrics can be observed.

EXAMPLE 3

Instead of the distearyl dimethyl ammonium chloride, commercial cationic surfactants are employed in stoichiometric proportions with anionic surfactants. The cationic materials used include di-tallowalkyl dimethyl ammonium chloride, as well as di-hydrogenated tallowalkyl dimethyl ammonium chloride, and also include Arquad® 2HT-75, Sherex® Arosurf® TA-100 and Armak® 2HT-Powder and the anionic detergent is Calsoft-90 or sodium lauryl sulfate. The tests run are substantially the same, and the results obtained are like those of Examples 1 and 2, showing superiority of the articles of this invention, and the importance of filtering the complex to prevent grease spotting. Similar test results are obtainable when the Kendall Corporation non-woven fabric is replaced with other non-woven fabrics, such as those used for dish cloths and Handi-Wipes®, which may be made of rayon or rayon-polyester blends.

EXAMPLE 4

When the proportions of the components of the articles of the previous examples, the proportions of the components of the detergent compositions, the concentrations of the detergent compositions in the wash water, and the molar proportions of cationic and anionic surfactants to form a complex are varied ±10%, ±20% and ±30%- in the experiments previously reported (Examples 1–3), while being kept within the ranges given in the specification, similar good results for the invented articles are obtainable. Such is also the case when the temperature and concentrations are similarly varied, while being maintained within the ranges specified. In another variation of the invention enough of the surfactants is added to the pouch so that it may be used for multiple washings. As many as three uses of the same pouch and contents are effective for fabric softening and preventing static cling (the pouch is not added to the dryer). In still other variations there are present with the mixture of surfactants in the pouch 20 parts of sodium tripolyphosphate powder and/or 24 parts of bentonite and/or 12 parts of TAM-20 emulsifier, and/or one part of perfume, and the variations are effective fabric softeners and antistats, and do not grease spot washed fabrics.

The invention has been described in conjunction with the descriptions, illustrations and working examples thereof but it is not to be limited to these because it is evident that one of skill in the art, with the present specification before him, will be able to utilize substitutes and equivalents without departing from the invention.

What is claimed is:

1. An antistatic and fabric softening laundry wash cycle additive article which comprises an antistatic and fabric softening composition in a filtering container, which composition comprises a complex of a cationic surfactant and an anionic surfactant, in which complex the molar proportion of the anionic surfactant is at least equimolar with respect to that of the cationic surfactant, or a mixture of cationic surfactant and anionic surfactant in which mixture the proportion of the anionic surfactant is at least equimolar with respect to that of the cationic surfactant, which complex or mixture is in a filtering container which is a non-woven pouch of fibrous material having wall openings which prevent passage therethrough of particles larger than 250 microns, when the container and its contents are added to wash water in an automatic washing machine, filters materials passing through it so that cationic/anionic surfactant complex passing through walls of the container is of a small enough size so that it does not form greasy deposits on laundry being washed.

2. An article according to claim 2 in which the composition in the pouch is a mixture of cationic surfactant and anionic surfactant, in which mixture the proportion of anionic surfactant is at least equimolar with respect to that of the cationic surfactant.

3. An article according to claim 1 in which the mixture is a particulate mixture of cationic surfactant and anionic surfactant in approximately equimolar proportions, the cationic surfactant is a quaternary ammonium salt or an imidazolinium salt, or a mixture thereof, and the anionic surfactant is a sulfonate, a sulfate or a carboxylate, or a mixture thereof, and the non-woven pouch of fibrous material prevents passage therethrough of particles larger than 50 microns.

4. An article according to claim 3 wherein the quaternary ammonium salt is a quaternary ammonium chloride, the imidazolinium salt is a chloride or a lower alkyl sulfate, the anionic surfactant is a higher alkylbenzene sulfonate, higher fatty alcohol sulfate, ethoxylated higher fatty alcohol sulfate of 1 to 30 moles of ethylene oxide per mole, or a mixture thereof and the non-woven pouch of fibrous material is of synthetic organic polymeric fibrous material which prevents passage therethrough of particles larger than 20 microns.

5. An article according to claim 4 wherein the cationic surfactant is di-hydrogenated tallowalkyl dimethyl ammonium chloride and the anionic surfactant is sodium linear tridecylbenzene sulfonate.

6. An article according to claim 5 wherein the composition in the pouch comprises a particulate material selected from the group consisting of builders and fillers for detergents, and carriers.

7. An article according to claim 5 wherein the composition in the pouch comprises an emulsifier for a complex of the cationic and anionic surfactants that is formed when the article is added to the wash water, which emulsifier assists in decreasing the particle size of the complex and thereby facilitates passage of the complex through the filtering pouch into the wash water.

8. An article according to claim 6 which comprises about ten parts total of cationic and anionic surfactants, and from 5 to 30 parts of particulate material selected from the group consisting of builders and fillers for detergents, and carriers.

9. An article according to claim 7 which comprises about ten parts by weight of the mixture of cationic and anionic surfactants and from 0.5 to 20 parts by weight of an emulsifier or mixture of emulsifiers for the complex.

10. An article according to claim 1 wherein the weight of cationic surfactant present in the complex or in the mixture is such as to soften and make antistatic a normal washload of laundry in an automatic washing machine of 60 to 70 liter capacity.

11. An article according to claim 10 wherein the weight of the cationic surfactant in the complex or the mixture is in the range of 2 to 20 grams and the article weighs 5 to 100 grams.

12. A process for simultaneously washing laundry and treating it to soften it and make it antistatic, which comprises washing the laundry in wash water with a synthetic anionic organic detergent composition and/or a synthetic nonionic organic detergent composition, which detergent composition is present in the wash water at a concentration in the range of 0.05 to 0.5%, in the presence, in the wash water, of an antistatic and fabric softening article of claim 1, rinsing the washed laundry and drying it.

13. A process according to claim 12 wherein the antistatic and fabric softening article is present with the washed laundry during the rinsing and drying operations, and drying is in an automatic laundry dryer of the tumbling type.

14. A process according to claim 13 wherein the wash water is at a temperature in the range of 30° to 95° C. and the laundry is washed with a built synthetic anionic organic detergent composition which includes 5 to 35% of synthetic anionic organic detergent, 10 to 80% of builder for such anionic detergent and 0 to 50% of filler salt, and the amount of cationic surfactant in the article is in the range of 0.005 to 0.05% of the wash water.

15. A process according to claim 14 wherein the wash water is in an automatic washing machine and its temperature is in the range of 30° to 60° C., the synthetic anionic organic detergent of the detergent composition is selected from the group consisting of higher fatty alcohol sulfates, higher alkylbenzene sulfonates, sulfated ethoxylated higher fatty alcohols, olefin sulfonates, paraffin sulfonates, monoglyceride sulfates, and mixtures thereof, the builder is selected from the group consisting of polyphosphates, carbonates, bicarbonates, borates, silicates, zeolites, and mixtures thereof, and the filler salt is sodium sulfate.

16. A process according to claim 15 wherein the temperature of the wash water is in the range of 35° C. to 50° C., the synthetic anionic organic detergent of the detergent composition is sodium linear higher alkylbenzene sulfonate, sodium higher fatty alcohol sulfate, sodium higher fatty alcohol ethoxylate sulfate, or a mixture thereof, the builder is sodium tripolyphosphate, sodium pyrophosphate, sodium carbonate, sodium bicarbonate, sodium silicate, sodium borate, or a mixture thereof, and the proportions of synthetic anionic organic detergent, builder and filler salt are in the ranges of 15 to 30%, 25 to 70%, and 0 to 40%, respectively.

17. A process according to claim 12 wherein the antistatic and fabric softening article is removed from the wash water and is reused in a wash water to soften and make antistatic at least one more load of laundry.

18. An article according to claim 1 which comprises, mixed with the complex of cationic surfactant and anionic surfactant in the filtering container, 0.5 to 20 parts by weight per ten parts by weight of combined cationic and anionic surfactants from which the cationic/anionic surfactant complex is made, of an emulsifer for the complex which is selected from the group consisting of ethoxylated higher alkyl amines, complexes of higher fatty acids with such ethoxylated higher alkyl amines, and mixtures thereof.

19. An article according to claim 9 wherein the emulsifier is an ethoxylated higher alkyl amine.

* * * * *